US005361671A

United States Patent [19]

Genna

[11] Patent Number: 5,361,671

[45] Date of Patent: Nov. 8, 1994

[54] RESILIENT DRUMSTICK SLEEVE ASSEMBLY

[76] Inventor: Robert A. Genna, 4 Talbot La., Greenwich, Conn. 06830

[21] Appl. No.: 754,743

[22] Filed: Sep. 4, 1991

[51] Int. Cl.[5] ..... G10D 13/02

[52] U.S. Cl. ..... 84/422.4

[58] Field of Search ..... 84/422.1, 422.2, 422.3, 84/422.4, 464 R, 464 A

[56] References Cited

U.S. PATENT DOCUMENTS

| | | | |
|---|---|---|---|
| 3,585,897 | 6/1971 | Stalcup | 84/422.4 |
| 3,688,013 | 8/1972 | Menard | 84/422.4 |
| 4,106,079 | 8/1987 | Drury | 84/464 R |
| 4,202,241 | 5/1980 | Lucas | 84/422.4 |
| 4,246,826 | 1/1981 | Warrick et al. | 84/422.4 |
| 4,318,612 | 3/1982 | Brannan et al. . | |
| 4,681,012 | 7/1987 | Stelma et al. | 84/844.2 |
| 4,702,143 | 10/1987 | Brockstein | 84/422.4 |
| 4,763,557 | 8/1988 | Donohoe | 84/422.4 |
| 5,179,237 | 1/1993 | Grossman | 84/422.4 |

FOREIGN PATENT DOCUMENTS

| | | |
|---|---|---|
| 56-142563 | 11/1981 | Japan . |
| 59-28177 | 2/1984 | Japan . |
| 59-72464 | 4/1984 | Japan . |

*Primary Examiner*—Stanley J. Witkowski

*Attorney, Agent, or Firm*—St. Onge Steward Johnston & Reens

[57] ABSTRACT

A resilient drumstick sleeve assembly comprises a drumstick and a resilient tubular polymeric sleeve fitted onto and covering the tapered neck section of the drumstick. The sleeve has a length of between about one inch to about seven inches and a thickness of between about 1/64 inch to about ⅛ inch and is provided with fluorescent coloration. The resilient drumstick sleeve assembly reduces drumstick breakage and provides the option of using the resilient sleeve to create new drumming sonics.

20 Claims, 2 Drawing Sheets

RESILIENT DRUMSTICK SLEEVE ASSEMBLY

FIELD OF THE INVENTION

The present invention relates to percussion instruments, and particularly to drumsticks.

BACKGROUND OF THE INVENTION

Drummers with an energetic drumming style such as rock band drummers have a tendency to break the tips off their drumsticks with great regularity. This arises because of gradual wear and chipping away of the drumstick as it hits against drum rims and cymbals. In addition, sudden cracking of the drumstick can be caused by a high velocity impact of the drumstick against a drumming surface. For example, a drummer in a heavy metal band may destroy as many as twenty drumsticks during the course of a single performance.

It would be desirable if a drumstick's durability could be enhanced to lengthen the drumstick's operating life.

SUMMARY OF THE INVENTION

It is an object of the present invention to provide a resilient drumstick sleeve assembly that reduces premature wear and drumstick breakage. It is an object of the present invention to provide a resilient drumstick sleeve assembly that has desirable ornamental features. It is an object of the present invention to provide a resilient drumstick sleeve assembly that can be used to devise new and different percussion sonics.

A resilient drumstick sleeve assembly in accordance with one technique of the invention comprises a drumstick and a resilient tubular sleeve fitted onto and covering a neck section of the drumstick. The drumstick has a cylindrical body at one end and a tip knob at a second end, and the neck section connects the cylindrical body to the tip knob. Preferably, the sleeve has a length of between about one inch to about seven inches, and most preferably, the sleeve has a length of between about one and one-half inches to about three inches. The sleeve preferably has a thickness of between about 1/64 inch to about ⅛ inch, and most preferably between about 1/32 inch to about 1/16 inch.

The sleeve preferably comprises a polymeric material, and is preferably provided with a high visibility coloration such as fluorescent coloration. In one preferred embodiment the sleeve is tapered, with a narrower diameter end adjacent the tip knob of the drumstick and a wider diameter end adjacent the cylindrical body of the drumstick. The sleeve can have a length selected whereby the drumstick tip knob is uncovered by the sleeve, or in an alternative embodiment, the length of the sleeve is selected so that the sleeve extends over the second end of the drumstick whereby the drumstick tip knob is covered by the sleeve.

The resilient drumstick sleeve assembly absorbs shock to reduce drumstick breakage. In addition, the resilient sleeve provides an alternative stick surface for a more muted drumming sound.

Other objects, aspects and features of the present invention in addition to those mentioned above will be pointed out in detail or will be understood from the following detailed description provided in conjunction with the accompanying drawings.

DETAILED DESCRIPTION OF THE DRAWINGS

DESCRIPTION OF THE PREFERRED EMBODIMENT

Figure 1:
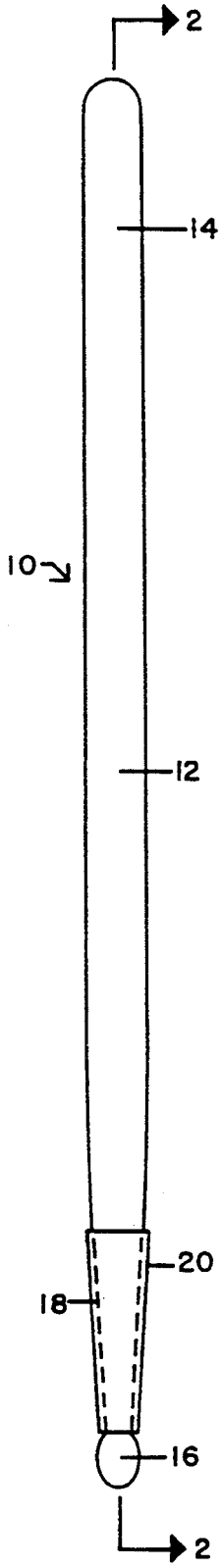
FIG. 1 is a top plan view of an embodiment of a resilient drumstick sleeve assembly in accordance with the invention.
Figure 2:
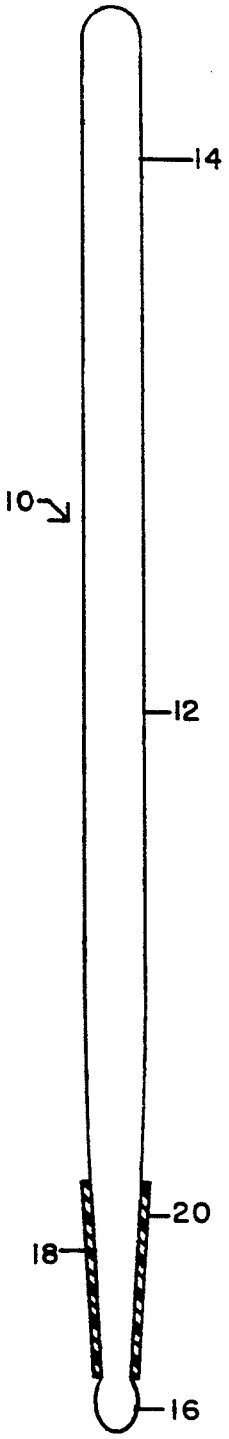
FIG. 2 is a cross-sectional view of the resilient drumstick sleeve assembly of FIG. 1 along the line 2—2 of FIG. 1.

Referring now to FIGS. 1–2, a resilient drumstick sleeve assembly in accordance with the invention is shown generally as 10. Like elements are identically numbered in the drawings. Assembly 10 comprises a drumstick 12 and a resilient sleeve 20. The drumstick 12 has a cylindrical body 14 at one end and a tip knob 16 at a second end, and a tapered neck section 18 which connects the cylindrical body 14 to the tip knob 16. Tapered neck section 18 has a taper whereby the diameter of the neck section 18 decreases along the axial length of the neck section 18 from the body 14 to the tip knob 16.

Figure 6:
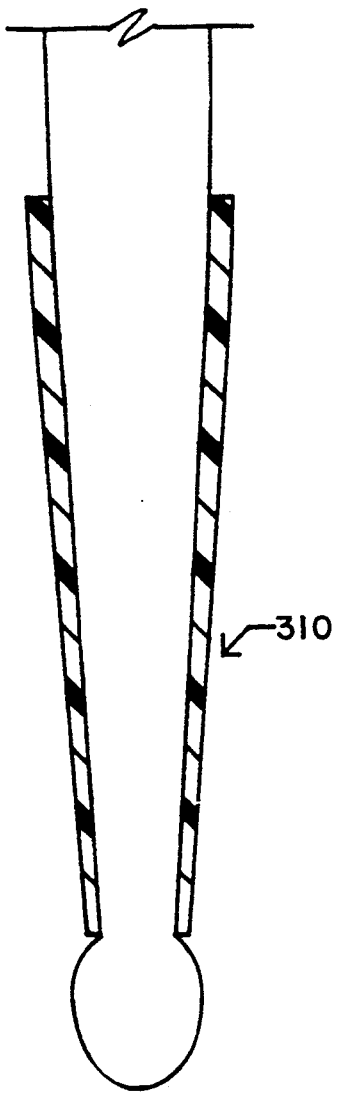
FIG. 6 is a cross-sectional view of an embodiment of a resilient drumstick sleeve assembly wherein a resilient sleeve has a varying thickness.

Sleeve 20 is a resilient tubular sleeve fitted onto and covering a tapered neck section 18 of the drumstick 12. As used herein, a "tubular sleeve" encompasses a sleeve having a generally cylindrical shape as well as a sleeve with a tapered, frusto-conical shape. The sleeve preferably does not cover the hand grip portions of the body 14. Preferably, sleeve 20 has a length of between about one inch to about seven inches, and most preferably, sleeve 20 has a length of between about one and one-half inches to about three inches. Sleeve 20 preferably has a thickness of between about 1/64 inch to about ⅛ inch, and most preferably between about 1/32 inch to about 1/16 inch. The thickness of sleeve 20 may be uniform, or it may vary. For example, the sleeve 20 may be provided with a lesser thickness adjacent the tip knob 16 and a greater thickness adjacent the body 14, as shown generally as 310 in FIG. 6.

Sleeve 20 preferably comprises a polymeric material, and is preferably provided with a high visibility coloration such as fluorescent coloration. Alternatively, transparent, or black or solid or pastel colors may be used. Sleeve 20 is preferably a polypropylene, polyethylene, polyurethane, or a vinyl elastomer. The resiliency of the sleeve 20 may vary depending on the material selected. A varying durometer will give varying percussion sonics. Sleeve 20 may be manufactured by cutting a length of extruded tubular sleeve from a spool of such tubing. Sleeve 20 may also be manufactured by molding, such as dip molding, appropriately sized sleeve elements in appropriately shaped dies. Manufacturing with a molding method permits manufacture of sleeves of varying thickness as disclosed above and shown in FIG. 6.

Figure 3:
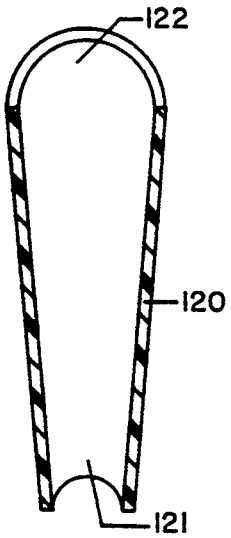
FIG. 3 is a cross-sectional view of an embodiment of a sleeve in accordance with the invention.

Referring now to FIG. 3, a preferred embodiment of the sleeve is shown as 120. Sleeve 120 is tapered, with a narrower diameter end 121 for locating adjacent a tip knob of a drumstick and a wider diameter end 122 for locating adjacent a cylindrical body of a drumstick.

Figure 4:
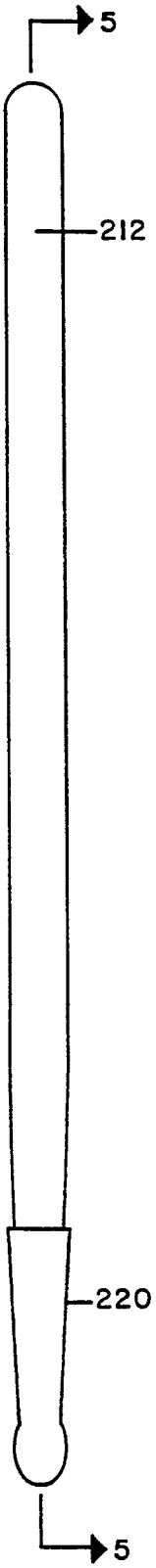
FIG. 4 is a top plan view of an alternative embodiment of a resilient drumstick sleeve assembly in accordance with the invention.
Figure 5:
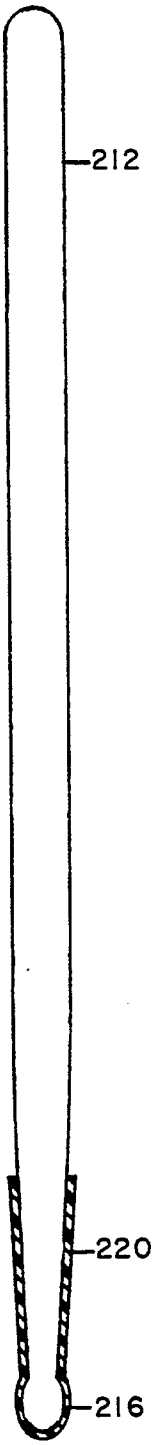
FIG. 5 is a cross-sectional view of the resilient drumstick sleeve assembly of FIG. 4 along the line 5—5 of FIG. 1.
Figure 7:
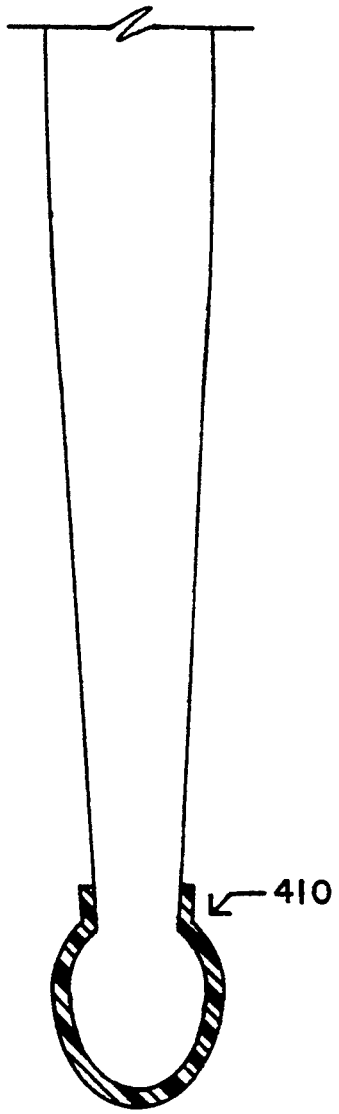
FIG. 7 is a cross-sectional view of an embodiment of a resilient drumstick sleeve assembly wherein a resilient sleeve covers only a tip end of a drumstick.

Referring again to FIGS. 1–2, sleeve 20 has a length selected whereby the drumstick tip knob 16 is uncovered by the sleeve 20. In an alternative embodiment shown in FIGS. 4–5, the length of the sleeve 220 is selected so that the sleeve 220 extends over the end of the drumstick 212 whereby the drumstick tip knob 216 is covered by the sleeve 220. In such an embodiment the end of the tip may also be covered so that the sleeve 220 would be closed at one end. The sleeve length in such case may be selected to cover only the tip knob as shown as 410 in FIG. 7 or both the tip knob and the neck section.

The resilient drumstick sleeves 20, 120 and 220 absorb shock to reduce drumstick breakage. In the event of breakage, the drumstick tip is prevented from uncontrolled travel away from the drummer. In addition, the resilient sleeve provides an alternative stick surface for a more muted drum or cymbal sound. For example, the resilient drumstick sleeve apparatus can be used in its sleeve area to create cymbal rolls with a smooth sound, or it can be used to create soft percussive sounds on the drum rim or on the beater head. This permits the creation of new drumming sonics. In addition, where the sleeve 220 covers the tip of the drumstick, a pair of the resilient drumstick sleeve apparati can be used for percussion practice on a tabletop or other hard surface without causing substantial damage to the surface.

Having now described several embodiments in accordance with the invention, its advantages may be appreciated. Other embodiments and variations of the invention may be made without departing from the scope of the following claims.

What is claimed is:

1. A resilient drumstick sleeve assembly comprising:

a conventional wooden drumstick having a cylindrical body at one end of said drumstick, and a neck section connecting said cylindrical body to a tip knob at a second end of said drumstick; and a resilient tubular sleeve fitted onto and covering at least a portion of said neck section and not at a hand holding section of said drumstick to provide a protective covering for said drumstick and to alter percussion sonics of said drumstick.

2. A resilient drumstick sleeve assembly in accordance with claim 1 wherein said sleeve is provided with fluorescent coloration.

3. A resilient drumstick sleeve assembly in accordance with claim 1 wherein said sleeve extends from said neck section over said second end of said drumstick whereby said drumstick tip knob is covered by said sleeve.

4. A resilient drumstick sleeve assembly in accordance with claim 1 wherein said sleeve has a length of between about one inch to about seven inches.

5. A resilient drumstick sleeve assembly in accordance with claim 4 wherein said sleeve has a length of between about one and one-half inches to about three inches.

6. A resilient drumstick sleeve assembly in accordance with claim 1 wherein said sleeve has a thickness of between about 1/64 inch to about ⅛ inch.

7. A resilient drumstick sleeve assembly in accordance with claim 6 wherein said sleeve has a thickness of between about 1/32 inch to about 1/16 inch.

8. A resilient drumstick sleeve assembly in accordance with claim 3 wherein said sleeve is tapered, having a narrower diameter end adjacent said tip knob of said drumstick and a wider diameter end adjacent said cylindrical body of said drumstick.

9. A resilient drumstick sleeve assembly in accordance with claim 6 wherein said sleeve has a varying thickness over its axial length.

10. A resilient drumstick sleeve assembly in accordance with claim 1 wherein said sleeve comprises a polymeric material.

11. A resilient drumstick sleeve assembly in accordance with claim 1 wherein said sleeve extends from said neck section over said body of said drumstick.

12. A resilient drumstick sleeve assembly comprising:

an integral conventional wooden drumstick having a cylindrical body at one end of said drumstick, and a neck section connecting said cylindrical body to a tip knob at a second end of said drumstick; and a resilient tubular polymeric sleeve fitted onto and covering at least a portion of said neck section and not at a hand holding section of said drumstick, said sleeve having a length of between about one inch to about seven inches and a thickness of between about 1/64 inch to about ⅛ inch, said sleeve providing a protective covering for said drumstick and altering percussion sonics of said drumstick when said drumstick is struck against a drumming surface.

13. A resilient drumstick sleeve assembly in accordance with claim 12 wherein said sleeve has a length of between about one and one-half inches to about three inches.

14. A resilient drumstick sleeve assembly in accordance with claim 12 wherein said sleeve has a thickness of between about 1/32 inch to about 1/16 inch.

15. A resilient drumstick sleeve assembly in accordance with claim 12 wherein said sleeve is tapered, having a narrower diameter end adjacent said tip knob of said drumstick and a wider diameter end adjacent said cylindrical body of said drumstick.

16. A resilient drumstick sleeve assembly in accordance with claim 12 wherein said sleeve covers a portion of said neck assembly and said sleeve extends over said second end of said drumstick whereby said drumstick tip knob is covered by said sleeve.

17. A resilient drumstick sleeve assembly in accordance with claim 12 wherein only said tip knob is covered by said sleeve.

18. A resilient drumstick sleeve assembly in accordance with claim 12 wherein said sleeve extends from said neck section over said body of said drumstick.

19. A resilient tubular sleeve for mounting on a neck section of a conventional wooden drumstick having a cylindrical body at one end of said drumstick, and a neck section connecting said cylindrical body to a tip knob at a second end of said drumstick, comprising:

a resilient tubular polymeric sleeve fitted onto and covering said neck section and not at a hand holding section of said conventional drumstick, said sleeve having a length of between about one inch to about seven inches and a thickness of between about 1/64 inch to about ⅛ inch, said sleeve being provided with high visibility coloration, said sleeve providing a protective covering for said drumstick and altering percussion sonics of said drumstick when said drumstick is struck against a drumming surface.

20. A resilient drumstick sleeve assembly in accordance with claim 19 wherein said sleeve extends from said neck section over said body of said drumstick.

* * * * *